US010397730B2

(12) United States Patent
Acharya

(10) Patent No.: US 10,397,730 B2
(45) Date of Patent: Aug. 27, 2019

(54) METHODS AND SYSTEMS FOR PROVIDING VIRTUAL SURROUND SOUND ON HEADPHONES

(71) Applicant: GLOBAL DELIGHT TECHNOLOGIES PVT. LTD., Udupi (IN)

(72) Inventor: M Ramachandra Acharya, Udupi (IN)

(73) Assignee: GLOBAL DELIGHT TECHNOLOGIES PVT. LTD., Udupi (IN)

( * ) Notice: Subject to any disclaimer, the term of this patent is extended or adjusted under 35 U.S.C. 154(b) by 0 days.

(21) Appl. No.: 16/070,700

(22) PCT Filed: Feb. 3, 2017

(86) PCT No.: PCT/IN2017/050052
§ 371 (c)(1),
(2) Date: Jul. 17, 2018

(87) PCT Pub. No.: WO2017/013468
PCT Pub. Date: Aug. 10, 2017

(65) Prior Publication Data

US 2019/0037334 A1 Jan. 31, 2019

(30) Foreign Application Priority Data

Feb. 3, 2016 (IN) ..... 201641003902

(51) Int. Cl.
*H04R 5/02* (2006.01)
*H04R 3/00* (2006.01)
(Continued)

(52) U.S. Cl.
CPC ..... *H04S 7/307* (2013.01); *H04R 3/04* (2013.01); *H04R 5/033* (2013.01); *H04R 5/04* (2013.01);
(Continued)

(58) Field of Classification Search
CPC ... H04R 5/00; H04R 5/02; H04R 5/04; H04R 3/00; H04R 3/04; H04R 3/12;
(Continued)

(56) References Cited

U.S. PATENT DOCUMENTS 5,438,623 A * 8/1995 Begault ..... H04S 1/005 381/17
5,742,689 A * 4/1998 Tucker ..... H04S 3/004 381/17
(Continued)

OTHER PUBLICATIONS

International Search Report and Written Opinion dated Jun. 28, 2017, PCT Patent Application No. PCT/IN2017/050052, filed Feb. 3, 2017, International Search Authority, 6 pages.

*Primary Examiner* — Thang V Tran
(74) *Attorney, Agent, or Firm* — Mannava & Kang, P.C.; Vinay Malik

(57) ABSTRACT

Method and system for providing virtual surround sound on headphones using input audio. Embodiments herein relate to sound processing and more particularly to providing surround sound on headphones. Embodiments herein disclose a method and system for simulating surround sound on a headphone, by emulating multiple speakers in 3D space by processing audio using Head Related Transfer Function (HRTF) filters and other audio processing filters, wherein the input to the headphone is stereo input.

19 Claims, 4 Drawing Sheets

(51) Int. Cl.

| | |
|---|---|
| ***H04S 7/00*** | (2006.01) |
| ***H04S 3/00*** | (2006.01) |
| ***H04S 5/00*** | (2006.01) |
| ***H04R 3/04*** | (2006.01) |
| ***H04R 5/033*** | (2006.01) |
| ***H04R 5/04*** | (2006.01) |

(52) U.S. Cl.
CPC ..... *H04S 3/004* (2013.01); *H04S 5/005* (2013.01); *H04S 2400/01* (2013.01); *H04S 2400/03* (2013.01); *H04S 2400/11* (2013.01); *H04S 2420/01* (2013.01)

(58) Field of Classification Search
CPC ..... H04S 2420/01; H04S 2400/01; H04S 2400/03; H04S 2400/11; H04S 7/307; H04S 3/00; H04S 3/004; H04S 5/00; H04S 5/005
See application file for complete search history.

(56) References Cited

U.S. PATENT DOCUMENTS

| | | | | |
|---|---|---|---|---|
| 2006/0277034 | A1 | 12/2006 | Sferrazza | |
| 2009/0122995 | A1* | 5/2009 | Kim | G10L 21/028 381/17 |
| 2009/0292544 | A1* | 11/2009 | Virette | G10L 19/008 704/501 |
| 2010/0054483 | A1* | 3/2010 | Mizuno | H04S 7/302 381/17 |
| 2010/0246831 | A1 | 9/2010 | Mahabub et al. | |
| 2010/0303246 | A1 | 12/2010 | Walsh et al. | |
| 2012/0093348 | A1* | 4/2012 | Li | H04S 3/002 381/300 |
| 2013/0077800 | A1 | 3/2013 | Pan | |
| 2013/0121516 | A1 | 5/2013 | Lamb et al. | |
| 2014/0037117 | A1 | 2/2014 | Tsingos et al. | |

* cited by examiner

METHODS AND SYSTEMS FOR PROVIDING VIRTUAL SURROUND SOUND ON HEADPHONES

CROSS REFERENCE

The present application is a national stage filing under 35 U.S.C. § 371 of PCT application number PCT/IN2017/050052, having an international filing date of Feb. 3, 2017, which claims priority to Indian Patent Application Number 201641003902 filed on Feb. 3, 2016, the disclosures of which are hereby incorporated by reference in their entireties.

TECHNICAL FIELD

Embodiments herein relate to sound processing and more particularly to providing surround sound on headphones.

BACKGROUND OF INVENTION

Human hearing is binaural, that means humans use both ears to hear sound from one or more sound sources. The sounds received by either human ear will vary in timing, intensity and frequency. The human brain to localize the sound source uses these variations in the sounds received by the human ear. There are surround sound solutions which use multiple speakers (such as front left, front center, front right, surround left, surround right and Low Frequency Effects (LFE)) to create 360° sound field around a listener.

However, in case of headphones, a listener usually listens to only stereo sound in stereo format. This results in the users listening to sounds through a headphone having an inferior listening experience, as compared to a user listening to the same sounds using a surround system.

OBJECT OF INVENTION

The principal object of this invention is to disclose methods and systems for simulating realistic virtual surround sound on a headphone using a pre-defined layout, by emulating multiple speakers in 3D space by processing audio using Head Related Transfer Function (HRTF) and other audio processing filters, wherein the input to the headphone is stereo input, but not limited to stereo input,

BRIEF DESCRIPTION OF FIGURES

This invention is illustrated in the accompanying drawings, throughout which like reference letters indicate corresponding parts in the various figures. The embodiments herein will be better understood from the following description with reference to the drawings, in which.

DETAILED DESCRIPTION OF INVENTION

Figure 1:
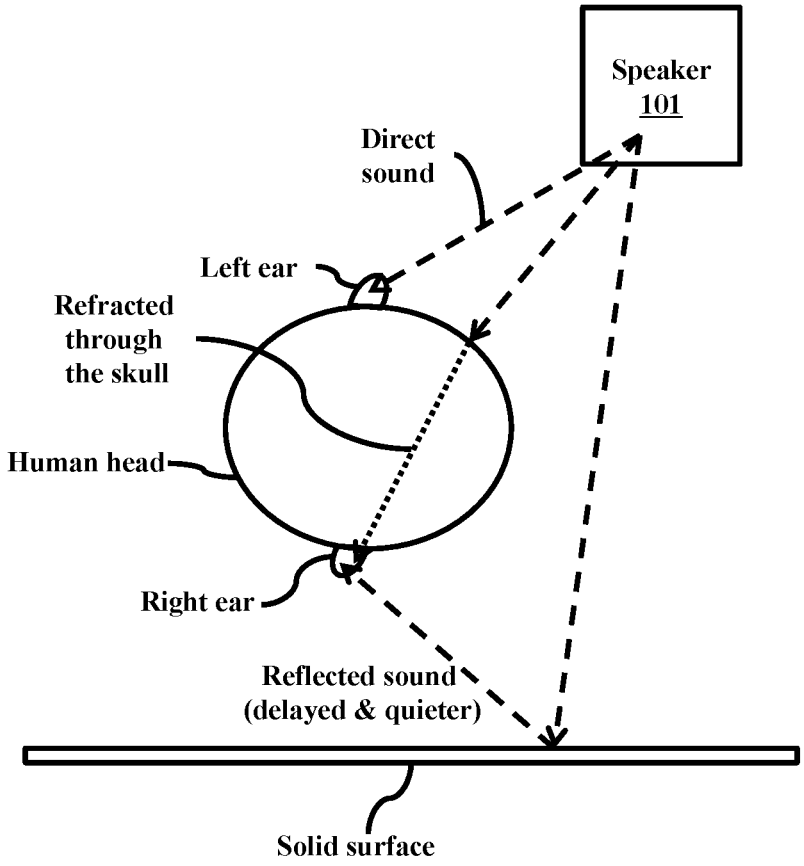
FIG. 1 illustrates a setup comprising of a user listening to sound provided by one speaker.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein achieve a method and system for simulating surround sound on a headphone, by emulating multiple speakers in 3D space by processing audio using Head Related Transfer Function (HRTF) filters, wherein the input to the headphone is at least one of stereo input or multi-channel audio input. Referring now to the drawings, and more particularly to FIGS. 1 through 4, where similar reference characters denote corresponding features consistently throughout the figures, there are shown preferred embodiments.

Human ear is most sensitive around 2.0 kHz to 3 kHz. For higher and lower frequencies the auditory threshold increases rapidly. To hear an audio of frequency as low as 30 Hz, the audio pressure must be around 50 db.

Human hearing is binaural, that means humans use both ears to hear sound from one or more sound sources. The sounds received by either human ear will vary in timing, intensity and frequency. The human brain to localize the sound source uses these variations in the sounds received by the human ear. The human brain determines the direction and location of sound using sonic cues such as Interaural Time Difference (ITD), and Interaural Level Difference (ILD). ITD refers to the time difference between the sound reaching each ear due to the difference in the distance between the sound source and each ear. When a sound comes from a speaker 101 placed on the left side of a user, the sound reaches the left ear earlier than the sound reaching the right ear (as depicted in FIG. 1). ILD refers to the pressure level (loudness) differences in sound at each ear caused by acoustic shadow of head. Sounds get softer as sound travels because the sound waves get absorbed by objects/surfaces. When a sound comes from a speaker 101 placed on the left side of a user, the left ear hears the sound a bit louder sound as compared to the right ear (as depicted in FIG. 1). Further, the brain uses spectral changes due to the shape of the pinnae of the ear to determine the elevation of the speaker 101.

A Binaural model makes use of these cues for sound localization to create a perception that a sound is originating from a specific point in the space using Head Related Transfer Function (HRTF). HRTF is a Fourier Transform of Head Related Impulse Response (HRIR) defined for each of the ears. It is dependent on the location of a sound source relative to the ear. HRTF captures transformations of sound waves propagating from a sound source to human ears. The transformations include the reflection and diffraction of sound through the human body. These transformations are directionally specific and can later be applied to any monaural sound source to give its physical characteristics needed to render the sound in 3D space. The speakers (sound sources) of the virtual surround system are positioned in the 3D space using HRTF.

Embodiments herein transform audio input (which can be at least one of stereo input or multi-channel audio input) in such a way that the listener will perceive that the sound is coming from multiple sources (speakers) outside his ear in a 3D (3-Dimensional) manner, while listening to the sound on his headphones. Embodiments herein provide a speaker layout specific for providing binaural surround sound on headphones, wherein the audio input is processed, audio elements from the processed audio input are extracted (wherein the audio elements can comprise of vocals, different instruments (such as drums), and so on) and render the audio elements on virtual front, rear, low frequency speakers (LFE) and high frequency speakers (tweeters) to create a surround sound experience on headphones.

The term 'headphone' herein refers to any device that provides sound to the ears and can be worn on or around the head of the user. The headphone can be an in-ear headphone (earphone), worn covering all or a portion of the ear of the user, or any other means that enables the sound to be provided directly to the ears of the user. The headphones can use a suitable means to receive the sound, such as a cable, or a wireless communication means (such as Bluetooth, radio waves, or any other equivalent means).

Embodiments herein use the terms 'user' and 'listener' interchangeably to denote one or more users who is currently listening to sounds from the headphones.

Figure 2:
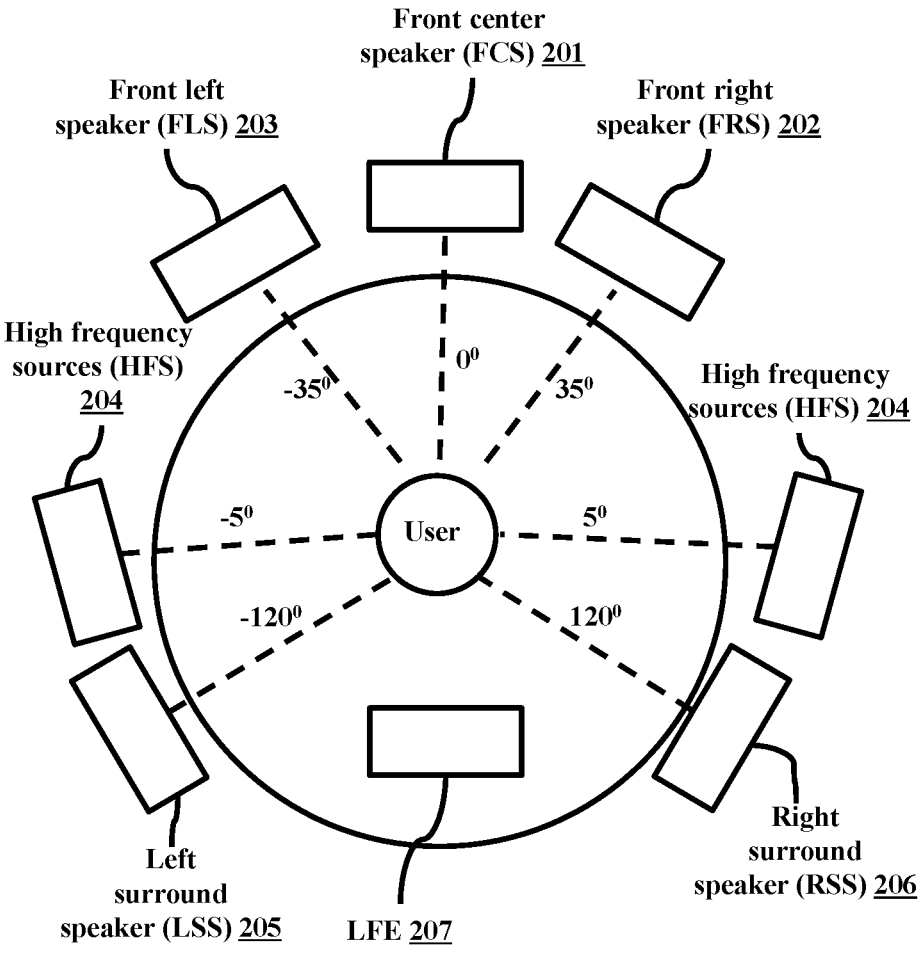
FIG. 2 depicts a speaker layout for providing virtual surround sound to a user, according to embodiments as disclosed herein.

FIG. 2 depicts an example of a virtual layout for a virtual surround system. The layout comprises of a Front Center Speaker (FCS) 201, a Front Right Speaker (FRS) 202, a Front Left Speaker (FLS) 203, a plurality of High Frequency Sources (HFS) 204, a Left Surround Speaker (LSS) 205, a Right Surround Speaker (RSS) 206, and a LFE (Low Frequency Effect) 207. The layout has a wider angle between the front left speaker 203 and front right speaker 202 than the standard 5.1 surround set up. In an example embodiment herein, the front left speaker 203 is at an angle of −35° from the vertical (location of the front center speaker 201) and front right speaker 202 is at an angle of 35° from the vertical (location of the front center speaker 201). The layout further has the surround speakers at a wider angle (as compared to the standard layout). In an example embodiment herein, the left surround speaker 205 is at an angle of −120° from the vertical (location of the front center speaker 201) and right surround speaker 206 is at an angle of 120° from the vertical (location of the front center speaker 201). The front speakers (the front center speaker 201, the front right speaker 202, and the front left speaker 203) are placed at an elevation of 10° from the horizontal plane of the ear of the user. The back speakers (left surround speaker 205 and the right surround speaker 206) are placed at an elevation of −5° from the horizontal plane of the ear of the user. The High frequency sources 204 are placed between the front speakers and the rear speakers, at a position a little behind of the line parallel to the ear of the user. In an example embodiment herein, the high frequency source 204 can be a tweeter. The LFE 207 can be placed virtually behind the listener. This layout results in the sound being uniform around the listener.

Embodiments herein filter an audio input to extract different elements (vocals, instruments (such as drums, piano, violins, and so on)) of the audio and render the extracted elements to which the human auditory system is very sensitive on the front speakers retaining their positions.

Figure 3:
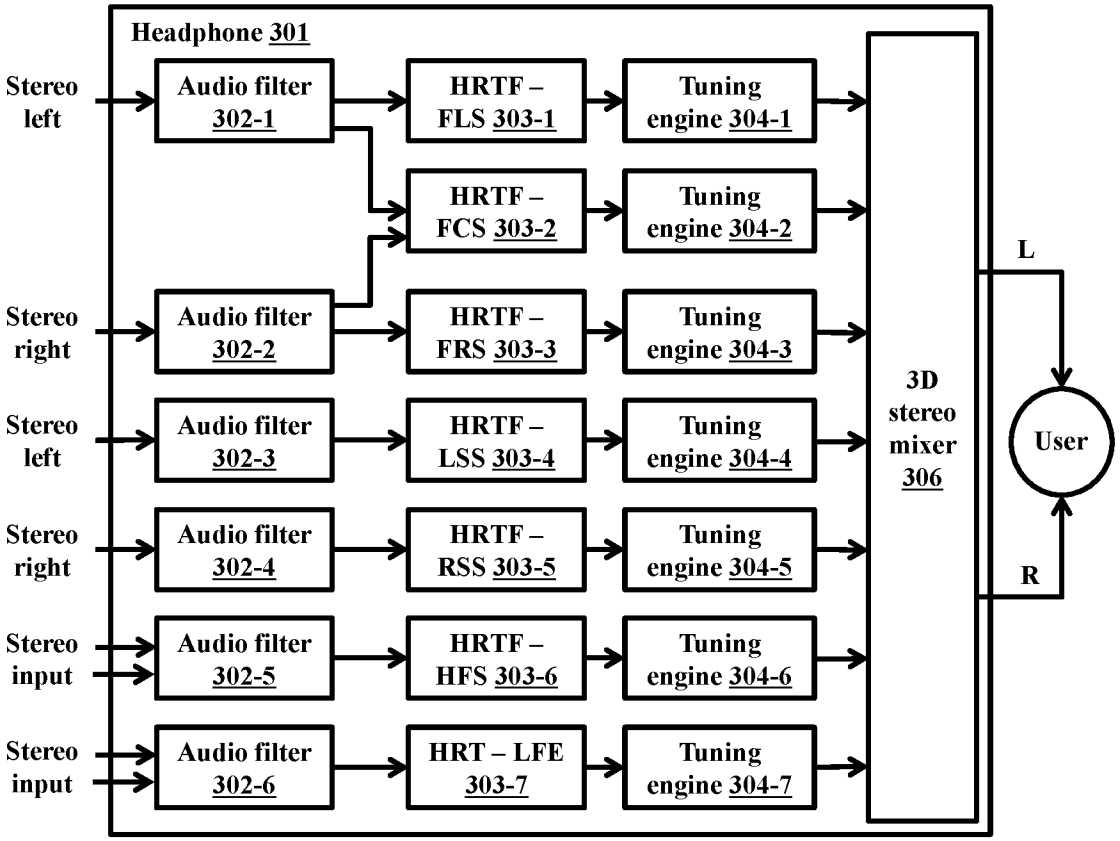
FIG. 3 depicts the process of localizing audio from a virtual speaker in 3D space, according to embodiments as disclosed herein.

FIG. 3 depicts a process of localizing audio from a virtual speaker in 3D space. The headphone 301 comprises of a plurality of audio filters 302, a plurality of HRTF filters 303, a plurality of tuning engines 304 and a 3D audio mixer 305. The headphone 301 comprises of audio filters 302 for each of the FLS 203, FCS 201, the FRS 202, the LSS 205, the RSS 206, the HFS 204 and the LFE 207. The headphone 301 comprises of HRTF filters 303 for each of the FCS 201, the FLS 203, the FRS 202, the LSS 205, the RSS 206, the HFS 204 and the LFE 207. The headphone 301 comprises of tuning engines 304 for each of the FCS 201, the FLS 203, the FRS 202, the LSS 205, the RSS 206, the HFS 204 and the LFE 207.

On receiving a audio as input, the audio filters 302 filters the input to extract different elements present in the input. The different elements present in the input can comprise of at least one of vocals, instruments, and so on. The input can also comprise of instruments with different ranges such as instruments with low frequency ranges, instruments with high frequency ranges, instruments with medium frequency ranges, and so on. The audio filters 302-1 and 302-2 can filter the frequencies to which a human auditory system is sensitive from the audio input, such as vocals, frequencies from instruments such as violin, piano and flute and so on. The audio filters 302-3 and 302-4 can filter the lower-mid frequencies from the audio input such as instruments such as lower-mid bass drum, bass guitar, viola, cello, and so on. The lower-mid frequencies add clarity to the bass sound. The audio filter 302-5 can filter the high frequency components from the audio input. These components add an extra clarity to vocals and melody instruments such as violin and flute making them sound more realistic. The audio filter 302-6 can filter the low frequency components (30-120 Hz) from the audio input. These low bass components provide a sense of the power or depth of sound.

The extracted elements are provided to the HRTF filters 303. The HRTF filters 303 can apply spatial cues to each of the elements using HRTF, provided a determined layout of virtual speakers (as depicted in FIG. 2). The HRTF-FCS 303-2 can combine the output from the audio filters 302-1 and 302-2 and renders common sound using the two channels of the audio input. The tuning engine 304 can tune the output of the HRTF filters 303, in terms of at least one factor such as volume, intensity, bass, treble, and so on. The tuning engine 304 can be pre-defined. An authorized user can control the tuning engine 304. The output is further mixed in a 3D audio mixer 305 and rendered on the left and right channels of the headphone 301.

If the audio input is multi-channel audio, audio corresponding to different channels (Front Left, Front Center, Front Right etc. including the LFE channel) can be fed directly to the HRTF filters 303. If separate high frequency and low frequency channel inputs are not available, they can be produced by passing the left and right channel audios through the high pass filter 302-6 and the low pass filter 302-5 as in case of stereo input.

Figure 4:
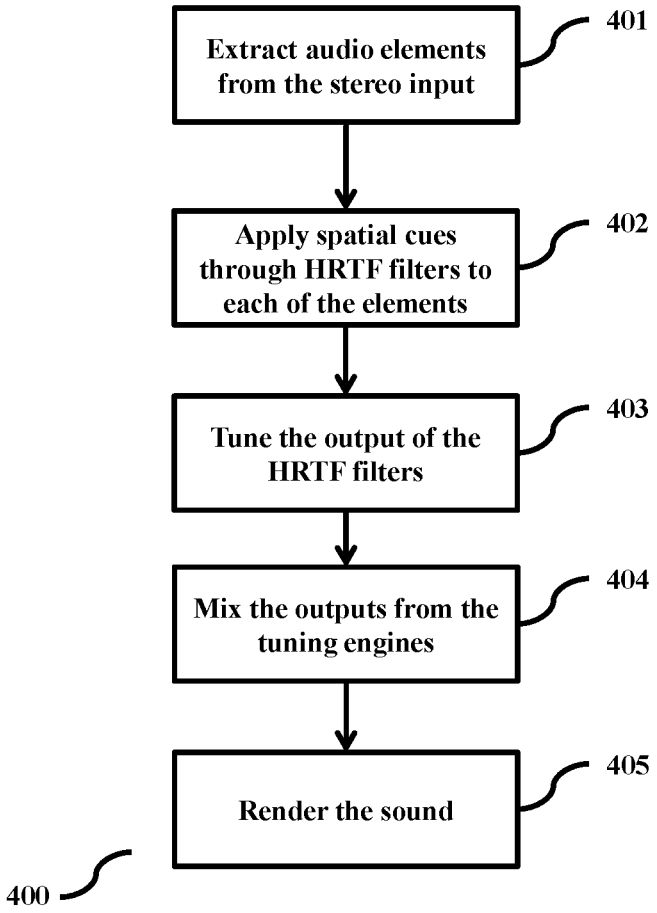
FIG. 4 is a flowchart depicting the process of audio processing and rendering for the binaural surround system, according to embodiments as disclosed herein.

FIG. 4 is a flowchart depicting the process of audio processing and rendering for the binaural surround system. On receiving an audio as input, the audio filters 302 filters (401) the input to extract different elements present in the input. The audio filters 302-1 and 302-2 can filter the frequencies to which a human auditory system is sensitive from the audio input, such as frequencies from instruments such as violin, piano and flute and so on. The audio filters 302-3 and 302-4 filters the lower-mid frequencies from the audio input such as instruments such as lower-mid bass drum, bass guitar, viola, piano, guitar, and so on. The audio filter 302-5 filters the high frequency components from the audio input. The audio filter 302-6 filters the low frequency components (30-120 Hz) from the audio input. The audio filters 302 provide the extracted elements to the HRTF filters 303. The HRTF filters 303 apply (402) spatial cues to each of the elements using HRTF, provided a determined location of the speaker in space and a layout (as depicted in FIG. 2). The tuning engines 304 tune (403) the output of the HRTF filters 303, in terms of at least one factor such as volume, intensity, bass, treble, and so on. The 3D audio mixer 305 mixes (404) the outputs from the tuning engines 304 and renders (405) the sound in 3D surround sound on the left and right channels of the headphone 301. The various actions in method 400 may be performed in the order presented, in a different order or simultaneously. Further, in some embodiments, some actions listed in FIG. 4 may be omitted.

Embodiments herein provide a binaural surround experience on an ordinary headphone using ordinary audio input, wherein the virtual surround experience is provided using the layout as depicted in FIG. 2. Embodiments herein propose a method and system for rendering different audio elements on different virtual speakers arranged in a layout (as depicted in FIG. 2) to give a surround experience on headphones.

The embodiment disclosed herein describes a method and system for simulating surround sound on a headphone, by emulating multiple speakers in 3D space by processing audio using Head Related Transfer Function (HRTF) filters, wherein the input to the headphone is audio input. Therefore, it is understood that the scope of the protection is extended to such a program and in addition to a computer readable means having a message therein, such computer readable storage means contain program code means for implementation of one or more steps of the method, when the program runs on a server or mobile device or any suitable programmable device. The method is implemented in a preferred embodiment through or together with a software program written in e.g. Very high speed integrated circuit Hardware Description Language (VHDL) another programming language, or implemented by one or more VHDL or several software modules being executed on at least one hardware device. The hardware device can be any kind of portable device that can be programmed. The device may also include means which could be e.g. hardware means like e.g. an ASIC, or a combination of hardware and software means, e.g. an ASIC and an FPGA, or at least one microprocessor and at least one memory with software modules located therein. The method embodiments described herein could be implemented partly in hardware and partly in software. Alternatively, the invention may be implemented on different hardware devices, e.g. using a plurality of CPUs.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

I claim:

1. A method for simulating surround sound on a headphone (301), the method comprising:

filtering an audio input to extract a plurality of elements present in the audio input by a plurality of audio filters (302), wherein the filtering of the audio input to extract a plurality of elements further comprising:

filtering frequency components from the audio input to which a human auditory system is sensitive by frequency audio filters (302-1, 302-2) included in the plurality of audio filters (302);

filtering lower-mid frequency components from the audio input by lower-mid frequency audio filters (302-3, 302-4) included in the plurality of audio filters (302);

filtering high frequency components from the audio input by high frequency audio filter (302-5) included in the plurality of audio filters (302); and filtering low frequency components from the audio input by low frequency audio filter (302-6) included in the plurality of audio filters (302);

applying spatial cues to each of the extracted plurality of elements by a plurality of Head Related Transfer Function (HRTF) filters (303) for a determined layout of a plurality of virtual speakers and combining, by the plurality of HRTF filters, the frequency components extracted by the audio filters (302-1, 302-2);

tuning output of the plurality of HRTF filters (303) by a plurality of tuning engines (304);

mixing the tuned output of the plurality of tuning engines (304) by a three-dimensional (3D) audio mixer (305); and rendering the mixed tuned output on a left and right channel of the headphone (301) by the three-dimensional (3D) audio mixer (305).

2. The method, as claimed in claim 1, wherein the audio input is at least one of a stereo input and a multi-channel audio input.

3. The method, as claimed in claim 1, wherein the determined layout of the plurality of virtual speakers comprises a Front Center Speaker (FCS) (201), a Front Right Speaker (FRS) (202), a Front Left Speaker (FLS) (203), a plurality of High Frequency Sources (HFS) (204), a Left Surround Speaker (LSS) (205), a Right Surround Speaker (RSS) (206), and a LFE (Low Frequency Effect) (207).

4. The method, as claimed in claim 3, further comprising placing the FCS (201), the FRS (202), and the FLS (203), at an elevation of 10° from a horizontal plane of the ear of a user of the headphone (301).

5. The method, as claimed in claim 3, further comprising, placing the FLS (203) and the FRS (203) such that there is a wider angle between the FLS (203) and the FRS (202) than a standard 5.1 surround set up.

6. The method, as claimed in claim 3, further comprising, placing the LSS (205) and the RSS (206) such that there is a wider angle between the LSS (205) and the RSS (206) than a standard 5.1 surround set up.

7. The method, as claimed in claim 3, further comprising, placing the LSS (205) and the RSS (206) at an elevation of −5° from the horizontal plane of the ear of the user of the headphone (301).

8. The method, as claimed in claim 3, further comprising, placing the plurality of HFS (204) behind a line parallel to an ear of the user of the headphone (301).

9. The method, as claimed in claim 3, further comprising, virtually placing the LFE (207) behind the user of the headphone (301).

10. An apparatus (301) comprising:

a plurality of audio filters (302) configured for filtering an audio input to extract a plurality of elements present in the audio input, wherein the plurality of audio filters (302) further comprising:

frequency filters (302-1, 302-2) configured for filtering frequency components from the audio input to which a human auditory system is sensitive;

lower-mid frequency filters (302-3, 302-4) configured for filtering lower-mid frequency components from the audio input;

high frequency filter (302-5) configured for filtering high frequency components from the audio input; and low frequency filter (302-6) configured for filtering low frequency components from the audio input;

a plurality of Head Related Transfer Function (HRTF) filters (303) configured for applying spatial cues to each of the extracted plurality of elements for a determined layout of a plurality of virtual speakers;

the plurality of HRTF filters (303) configured for combining the frequency components extracted by the audio filters (302-1, 302-2);

a plurality of tuning engines (304) configured for tuning output of the plurality of HRTF filters (303);

a three-dimensional (3D) audio mixer (305) configured for mixing the tuned output of the plurality of tuning engines (304); and the three-dimensional (3D) audio mixer (305) configured for rendering the mixed tuned output on a left and right channel of the headphone (301).

11. The apparatus, as claimed in claim 10, wherein the audio input is at least one of a stereo input and a multi-channel audio input.

12. The apparatus, as claimed in claim 10, wherein the determined layout of the plurality of virtual speakers comprises a Front Center Speaker (FCS) (201), a Front Right Speaker (FRS) (202), a Front Left Speaker (FLS) (203), a plurality of High Frequency Sources (HFS) (204), a Left Surround Speaker (LSS) (205), a Right Surround Speaker (RSS) (206), and a LFE (Low Frequency Effect) (207).

13. The apparatus, as claimed in claim 12, wherein the FCS (201), the FRS (202) and the FLS (203) are placed at an elevation of 10° from a horizontal plane of the ear of a user of the headphone (301).

14. The apparatus, as claimed in claim 12, wherein there is a wider angle between the FLS (203) and the FRS (202) than a standard 5.1 surround set up.

15. The apparatus, as claimed in claim 12, wherein there is a wider angle between the LSS (205) and the RSS (206) than a standard 5.1 surround set up.

16. The apparatus, as claimed in claim 12, wherein the LSS (205) and the RSS (206) are placed at an elevation of −5° from the horizontal plane of the ear of the user of the headphone (301).

17. The apparatus, as claimed in claim 12, wherein the plurality of HFS (204) are placed behind a line parallel to an ear of the user of the headphone (301).

18. The apparatus, as claimed in claim 12, wherein the plurality of HFS (204) are a plurality of tweeters.

19. The apparatus, as claimed in claim 12, wherein the LFE (207) is virtually placed behind the user of the headphone (301).

* * * * *